United States Patent [19]

Töbel

[11] 4,262,506

[45] Apr. 21, 1981

[54] CYLINDER LOCK WITH WARNING OF ENTRY AND DRILLING ATTEMPTS

[75] Inventor: Helmut Töbel, Hameln, Fed. Rep. of Germany

[73] Assignee: Zeiss Ikon Ag Goerzwerk, Fed. Rep. of Germany

[21] Appl. No.: 883,400

[22] Filed: Apr. 24, 1978

[30] Foreign Application Priority Data

Feb. 25, 1977 [DE] Fed. Rep. of Germany ..... 2708141

[51] Int. Cl.[3] ..... E05B 63/00

[52] U.S. Cl. ..... 70/419; 70/441; 70/DIG. 49

[58] Field of Search ..... 70/416, 419, 421, 431, 70/432, 439, 441, DIG. 49, 364 A; 340/542, 543

[56] References Cited

U.S. PATENT DOCUMENTS

| | | | |
|---|---|---|---|
| 2,838,748 | 6/1958 | Torma | 70/439 |
| 3,181,320 | 5/1965 | Bauer | 70/421 |
| 3,550,410 | 12/1970 | Toepfer | 70/364 A |
| 3,962,695 | 6/1976 | Peters | 340/542 |

*Primary Examiner*—Robert L. Wolfe

*Attorney, Agent, or Firm*—Hill, Van Santen, Steadman, Chiara & Simpson

[57] ABSTRACT

A device for detecting entry or drilling attempts into cylinder locks. One or more housing bores not corresponding to core bores when the lock is in a neutral position having spring biased tripping pins connected to an alarm or indicator system and operable when an entry attempt is made not using a proper key or after having drilled-out the tumbler or tumbler and cylinder pins. The tripping pins detect the rotated cylinder having a space in the cylinder bore due an improperly made key or due to the cylinder bore having previously been emptied by the drilling operation.

9 Claims, 4 Drawing Figures

CYLINDER LOCK WITH WARNING OF ENTRY AND DRILLING ATTEMPTS

SUMMARY OF THE INVENTION

The invention consists of a combination of a multi-cylinder lock or cross-beard-lock having one or more housing bores axially disposed with respect to the tumbler to be protected, loaded with spring biased trip pins, such that an attempt to rotate the cylinder of the lock by either drilling out the tumblers or by using an entry device will be detected by the additional trip pins due to the fact that the cylinder pins will either have been removed, in the case where the tumblers have been drilled out, or improperly depressed, due to the use of an entry device, so that even though the cylinder pins still reside within the cylinder, they are not effective to keep the trip pins from entering the cylinder bore, thereby setting off an alarm connected to a switch closed by that spring biased trip pin. One or more trip pins may be associated with a given tumbler.

BACKGROUND OF THE INVENTION

1. Field of the Invention

The field of the invention is that of burglar alarm and anti-intrusion devices.

2. Prior Art

The prior art does not disclose an inexpensive, effective device which is an integral part of a cylinder or cross-beard-lock to provide notice or an alarm when tampered with.

DESCRIPTION OF THE PREFERRED EMBODIMENTS

Figure 1:
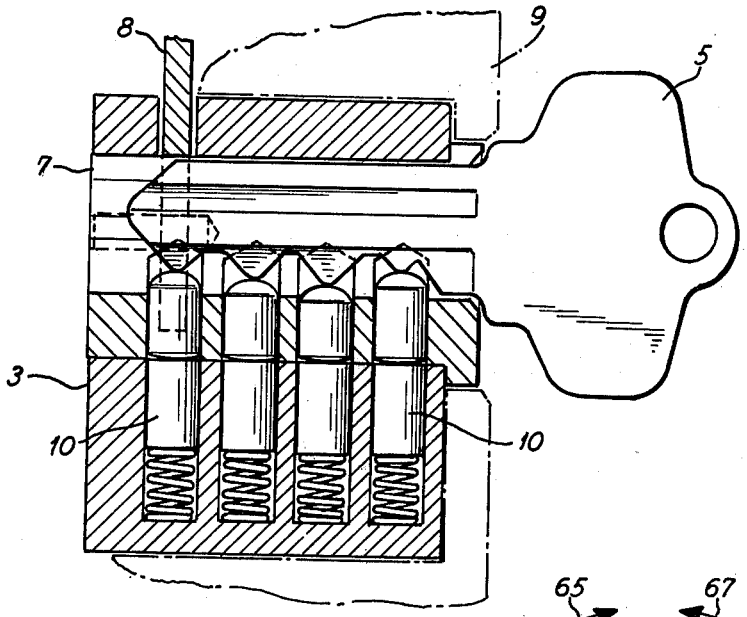
FIG. 1 is a section view showing a multi-cylinder lock with a key inserted depressing the cylinder pins properly.

While the principles of the present invention find a particular utility in an alarm for cylinder locks, it will be understood that the alarm arrangement of the present invention may be utilized in other combinations. By way of exemplary disclosure of the best mode of practicing the invention there is shown generally in FIG. 1, a side view of a multi-tumbler lock 3 wherein a key 5 has been indicated having a cylinder 7 with a latch 8 mounted in a door 9. The key 5 of FIG. 1, is shown as a flat key. However, the invention works equally well with cross-beard-key-locks. The invention involves adding additional trip pins in the lock 3 associated with some or all of the tumbler 10 so that if there is an attempt to drill the lock out or to use some sort of an entry device, an alarm or an alarm indicating device of some sort may be actuated by the additional trip pins.

Figure 2:
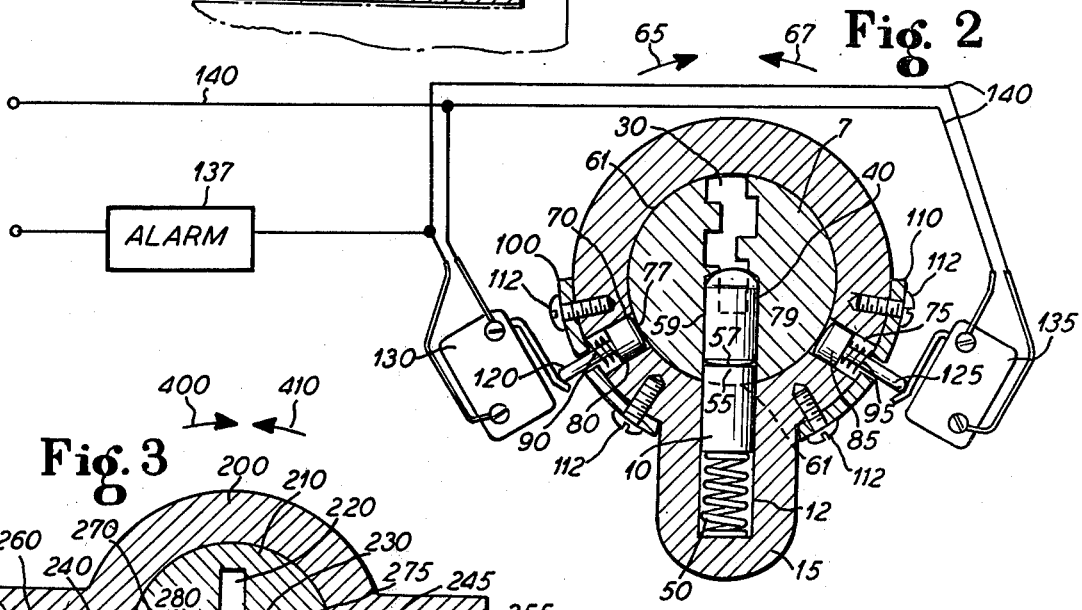
FIG. 2 is a section of a typical cylinder pin showing the radially affixed tripping pins.

FIG. 2 is a section of a typical tumbler 10 mounted in a bore 12 of a housing 15 containing the cylinder 7. The cylinder 7 has a key slot 30, a cylinder pin 40 and a spring 50 operable to force the tumbler 10 against the cylinder pin 40 which in turn places an upper surface 55 of the tumbler 10 against the bottom 57 of the cylinder pin 40 such that any attempt to turn the cylinder 7 will cause a bore 59 of the cylinder 20 associated with the tumbler 10 to bear against the tumbler 10 which extends from the non-moving housing 15 in the bore 12 part way into the bore 59 which must be able to turn before the cylinder 7 can turn and unlock the latch 8.

When a proper entry is undertaken a key 5 is inserted into the key slot 30 which when properly positioned with respect to the tumblers 10 in the lock 3, depresses the cylinder pin 40 which in turn bears against the upper surface 55 of the tumbler 10 depressing the compression spring 50 to the extent that the upper surface 55 becomes aligned with the perimeter 61 of the housing 15. When this has occurred, the upper surface 55 of the tumbler 10 no longer locks the rotation of the cylinder 7 since it is completely out of the bore 59. Once the tumbler 10 has been depressed so that it no longer resides to any extent in the bore 59, then the cylinder 7 may be turned either in a clockwise direction 65 or counter-clockwise direction 67.

However, when the lock 3 is attempted to be opened by means of either drilling in and damaging the tumblers 10 or drilling and damaging or removing the compression spring 50 found in the bore 12 of the housing 15 or by means of some sort of an entry device, not a proper key, which would be fitted into the slot 30 and attempts to depress the cylinder pin 40 by an amount such that the tumbler 10 clears the cylinder 7 allowing the cylinder 7 to rotate, a completely different set of conditions prevail than those conditions previously discussed where a proper key was used. To detect this different set of conditions which indicates either a drilled lock or a lock attempted to be opened by a substitute key, at least one additional housing bore is provided which is not opposite a cylinder bore when the lock is in an idle position. FIG. 2 discloses two additional housing bores 70, 75 distributed angularly on each side of the tumbler 10. It will be readily understood, that a typical tumbler 10 is being discussed and that the housing bores 70 and 75 are typical of those that one could incorporate for use with every tumbler in the lock 3. The housing bores 70 and 75 are positioned in the housing 15 so that the cylinder surfaces respectively 77 and 79 opposite the housing bores 70 and 75 do not contain cylinder bores but instead are solid when the cylinder 7 is in its idle position in the lock 3. Within the cylinder bores 70 and 75 are found respectively a pair of trip pins 80 and 85 biased by a pair of compression springs 90 and 95 and held into place by a pair of latch pieces 100 and 110 by screws 112. Each of the trip pins 80 and 85 has affixed to it an extension lever 120 and 125 connected to a pair of switches 130 and 135. The switches 130 and 135 are themselves connected to an alarm or indicator unit 137 by connecting wires 140. When an attempt is made to open the lock 3 using the proper key 5, as noted previously, the cylinder pin 40 depresses the tumbler 10 so that the tumbler 10 no longer interferes with the rotation 65, 67 of the cylinder 7. Once the rotation in the direction 65 or 67 has commenced, because the key 5 is still in the slot 30 the cylinder pin 40 continues to be held against the perimeter 61 of the housing 15. As a result, if the cylinder 20 is turned in a clockwise direction 65, when the bore 59 of the cylinder 7 is aligned with the bore 70 in the housing 15 containing the trip pin 80, the trip pin 80 is unable to travel into the bore 59 of the cylinder 7 under the urging of the spring 90. Thus, the switch 130 will not set off the connected alarm. However, if the cylinder 7 had been rotated clockwise 65 because the tumbler 10 had been drilled out as opposed to the fact that a proper key had been used or because an entry device of some sort had been inserted into the slot 30 thereby depressing the cylinder pin 40 adequately so that the tumbler 10 no longer locked, the cylinder 7, when the bore 59 became aligned with the bore 70, the trip pin 80 due to the urging of the compression spring 90 would be driven into the bore 59, there being no properly aligned cylinder pin 40 to continue to retain it thus allowing the switch 130 connected by the rod 120 to the trip pin 80 to set off the alarm 137. An identical sequence of events would take place when the cylinder 7 is turned in the counterclockwise direction 67 under either the action of a proper key 5 in the slot 30 or due to the fact that the tumbler 10 has been removed because it had been drilled out. It should be noted that the compression springs 90 and 95 need not themselves appear as indicated in the bores 70 and 75 but in fact may be an integral part of the switches 130 and 135.

Further, while exemplary compression springs 90 and 95 have been disclosed, it will be appreciated that any suitable form of biasing means could be effectively utilized without departing from the spirit of this invention.

Figure 3:
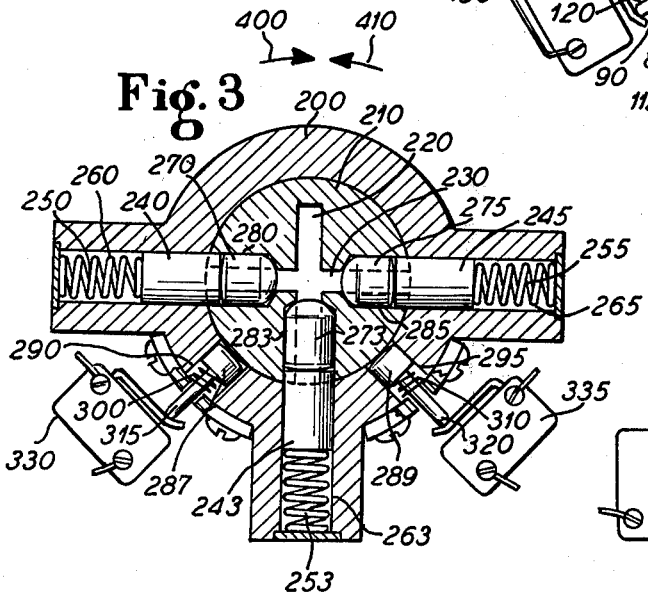
FIG. 3 is a section of a typical cylinder pin as in a cross-beard-key-lock showing the radially affixed tripping pins.

FIG. 3 discloses the invention used with a cross-beard-lock. In the case of a cross-beard-lock, one has a housing 200 having a cylinder 210 and a key slot having two sections 220 and 230 perpendicular to one another. Thus, as can be seen, the key structure required for a cross-beard-lock is substantially complex then the flat key 5 required for the multi-cylinder lock 3 of FIG. 1. FIG. 3 discloses one tumbler section of a cross-beard-lock such as has been known in the prior art which is typical of one or more such sections that may be present in such a lock. The invention herein disclosed may be utilized with one or all of such tumbler sections of a cross-beard-lock. The typical section shown in FIG. 3 has three tumblers 240, 243 and 245. The invention is, however, not restricted to a three tumbler cross-beard-lock. Each of the three tumblers 240, 243 and 245 has associated with it a spring of a compression variety 250, 253 and 255. The tumbler and spring structure is found in a set of housing bores 260, 263 and 265. Corresponding to each of the three example tumblers 240, 243, 245 is a cylinder pin 270, 273 and 275 present in a cylinder housing 280, 283 and 285. The process of unlocking the cross-beard-lock using a key in the slot composed of the two right angle sections 220 and 230 proceeds in essentially the same fashion as for the multi-cylinder lock 3 of FIG. 1. Angularly mounted with respect to a selected one of the tumblers 240, 243 and 245, is a pair of trip pins 287, 289 found in housing bores 290 and 295. The trip pins 287 and 289 are biased by a set of compression springs 300 and 310 and are connected by rods 315 and 320 to a pair of indicator switches 330 and 335. The indicator switches 330 and 335 would be wired to an immediate alarm or some sort of an indicator system. As can be seen in FIG. 3, when the cylinder 210 is turned by means of a proper key in the slot composed of the two perpendicular sections 220 and 230, the cylinder pins 270, 273 and 275 respectively, lock the trip pins 287 and 289 from entering any of the cylinder bores 280, 283 and 285. As a result, an alarm connected to the switches 330 and 335 is not turned on. If the cylinder pin 270 or 273 or 275 is removed due to the fact that the housing bore 263 has been drilled into, then when the cylinder 210 is turned, 400 or 410, the bore 280 or 283 or 285 or all will be empty and upon lining up with the bore 290 or the bore 295 the trip pins 187 or 189 will be driven into the cylinder 210 by the spring 300 or 310, respectively, thus setting off any alarm connected to the switch 230 and 235. A similar result follows if an entry device, not a proper key, is used to cause the cylinder 210 to rotate 400 or 410.

Figure 4:
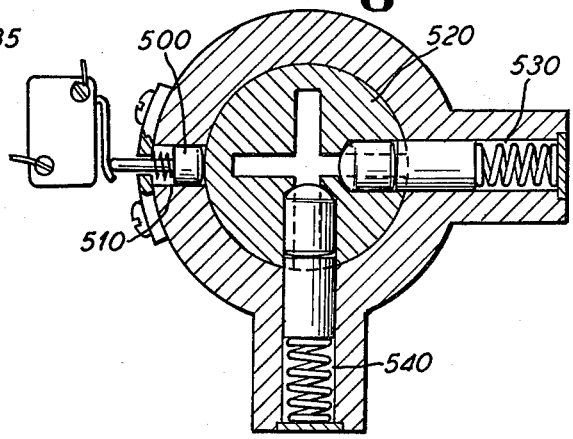
FIG. 4 is a typical section of a cylinder for use with a cross-beard-key-lock with a trip pin mounted for alarm purposes in a standard cylinder pin bore.

FIG. 4 discloses a variation of the cross-beard-lock of FIG. 3 wherein a trip pin 500 may be mounted in a housing bore 510 which corresponds to an existing housing bore which could alternately be filled with a tumbler and cylinder pin. This variation minimizes manufacturing steps but still provides the benefits of the invention disclosed herein. It should be noted that this case will require a cylinder 520 which does not have a bore facing the bore 510 when the cylinder 520 is in the idle position. Note that bores 530 or 540 could also have been chosen to contain the tripping pin 500.

Thus, the tripping pins of the present invention operate as continuously loaded feeler fingers to monitor conditions within the bore. Normally, the tumbler cylinder, on the key-actuated tumbler pins, will counterload feeler fingers in an opposite direction. However, if an opening is detected by the feeler fingers resulting from use of an unauthorized key or from an unauthorized evacuation of the cylinder bore, an alarm signal circuit will be actuated through a switch control means actuated in response to a movement of the feeler fingers.

Although various modifications might be suggested by those skilled in the art, it should be understood that I wish to embody within the scope of the patent warranted hereon all such modifications as reasonably and properly come within the scope of my contribution of the art.

I claim as my invention:

1. An improved lock comprising a housing having a cylinder rotatably mounted therein;

said cylinder containing a key slot;

said housing containing spring biased means for locking operable to engage a cylinder bore in said cylinder and block said cylinder from rotating;

said spring biased means for locking being operable to be disengaged from said cylinder bore under the action of a key inserted into said key slot; the improvement comprising, radially oriented means for sensing, mounted in said housing and operable to detect the rotation of said cylinder in response to the removal of elements of said means for locking or in response to the rotation of said cylinder brought about by an entry tool not a proper key by sensing an improper void within said cylinder bore, said means for sensing comprising spring-biased trip means operably connected to an external alarm;

said cylinder containing a boring therethrough engageable by said tumbler means to block rotation of said cylinder;

said boring containing further a cylinder pin against which said tumbler means bears and which cylinder pin is susceptible to damage or removal upon drilling attempts in the area of the tumbler means;

said trip means being operable to detect the rotation of said cylinder upon drilling attempts to permit said trip means to enter said boring when said cylinder has been rotated to align said boring with said trip means.

2. A lock comprising a housing having a cylinder rotatably mounted therein;

said cylinder containing a key slot;

said housing containing spring biased tumbler means operable to engage and block said cylinder from rotating;

said spring biased tumbler means being operable to be disengaged from said cylinder under the action of a key inserted into said key slot;

said housing containing further means operable to detect the rotation of said cylinder in response to the removal of said tumbler means or in response to the rotation of said cylinder brought about by an entry tool not a proper key; and wherein said further means comprises spring biased trip means operably connected to an external alarm;

said cylinder containing a boring therethrough engageable by said tumbler means to block rotation of said cylinder;

said boring containing further a cylinder pin against which said tumbler means bears;

said trip means being operable to detect the rotation of said cylinder due to said tumbler means having been removed or disengaged by an entry tool not a proper key, permitting said trip means to enter said boring when said cylinder has been rotated to align said boring with said trip means.

3. A lock capable of warning of entry and drilling attempts comprising:

a housing; a cylinder rotatably mounted within said housing;

said cylinder containing a key slot;

said housing having at least one spring biased tumbler mounted in a first boring therethrough and being urged by said biasing spring into a boring operably aligned in said cylinder; having within said cylinder boring a cylinder pin operable to block the advance of said tumbler into said boring of said cylinder beyond a predetermined point;

said housing having a further boring angularly disposed with respect to the said first boring and aligned with respect to an unbored surface of said cylinder;

said further housing boring having mounted therein spring biased sensing means operably connected to an alarm mechanism with a surface of said spring biased sensing means slidingly engaging said unbored surface of said cylinder;

said spring biased sensing means being operable to operate said alarm mechanism whenever said cylinder has been rotated such that said cylinder pin mounted within said boring of said cylinder does not slidingly contact said surface of said spring biased sensing means which had been in sliding contact against the surface of said cylinder, when said cylinder was in the locked condition with said tumbler being extended into said boring of said cylinder by said biasing spring, without permitting transverse displacement by said spring biased sensing means into said boring of said cylinder.

4. The lock according to claim 3 wherein said spring biased sensing means comprises a spring biased tripping pin operably connected to said alarm mechanism.

5. The lock mechanism according to claim 4 containing further, switch means operably connected to said spring biased tripping pin and to said alarm mechanism.

6. The lock according to claim 3 operable to receive a flat key.

7. The lock according to claim 3 operable to receive a cross-beard-lock key.

8. A lock comprising, a housing having a cylinder bore, a key actuated tumbler cylinder rotatable in said cylinder bore, said housing and said tumbler cylinder having a plurality of selectively registrable bores formed therein receiving spring pressed tumbler and cylinder pins for interlocking the housing and the tumbler cylinder with the tumbler pins of the tumbler selectively actuatable by a key to form contiguous continuous relatively rotatable concentric surfaces, tripping pin means carried by said housing and biasing means loading said tripping pin means toward said tumbler, circuit means including a signal alarm and switch means actuatable in response to a selected movement of said tripping pin means, whereby said tripping pin means will detect spaces in the cylinder due to use of an unauthorized key where the unauthorized evacuation of the cylinder bore and an alarm signal will be actuated.

9. For use in a cylinder lock, having a cylinder bore with a cylinder pin movable therein, the improvement comprising:

means for sensing mounted in the lock, off-set with respect to the cylinder bore, and adapted to detect a space in the cylinder bore resulting from unauthorized evacuation of the cylinder bore or from use of an unauthorized key, upon a rotation of the cylinder a selected amount and means for signalling, operable to generate a selected signal in response to said means for sensing detecting the space in the rotated cylinder bore.

* * * * *